United States Patent [19]
Wertepny
[11] 4,221,020
[45] Sep. 9, 1980

[54] LOW-VISIBILITY LAZY-TONGS MECHANISM FOR CONVENTIONAL TRAVERSE RODS FOR EVEN FOLDING AND UNFOLDING OF DRAPERY

[76] Inventor: Joseph R. Wertepny, 1614 Parnell St., Marinette, Wis. 54143

[21] Appl. No.: 32,262

[22] Filed: Apr. 23, 1979

Related U.S. Application Data

[63] Continuation-in-part of Ser. No. 790,849, Apr. 25, 1977, Pat. No. 4,152,809.

[51] Int. Cl.[2] ..... A47H 1/04; A47H 15/00; E05D 13/02; E05D 15/06

[52] U.S. Cl. ..... 16/96 D; 160/342; 160/348

[58] Field of Search ..... 16/96 D, 95 DW, 95 P, 16/94 C, 94 D; 160/342, 348

[56] References Cited

U.S. PATENT DOCUMENTS 3,013,603 12/1961 Rosenberg ..... 160/342
3,045,747 7/1962 Hill ..... 160/342
3,312,262 2/1964 Mitchell ..... 160/342 X

FOREIGN PATENT DOCUMENTS 459491 5/1928 Fed. Rep. of Germany .
2342676 1/1974 Fed. Rep. of Germany ..... 160/342

*Primary Examiner*—Ronald Feldbaum
*Attorney, Agent, or Firm*—Ralph F. Staubly

[57] ABSTRACT

A lazy-tongs device is formed of length-adjustably snap-connected colorless transparent or translucent plastic elements sufficiently small so as not to interfere with the folding of the drapes and so as to be substantially concealed behind the traverse rod when the controlled drapes are fully unfolded. In one disclosed species, large plastic trim rings also substantially conceal the low-visibility lazy-tong elements when the drapes are folded. In a second species the drapery supports hold the top of the drapes close to the traverse rod for substantial concealment of the lazy-tongs when fully closed.

10 Claims, 9 Drawing Figures

LOW-VISIBILITY LAZY-TONGS MECHANISM FOR CONVENTIONAL TRAVERSE RODS FOR EVEN FOLDING AND UNFOLDING OF DRAPERY

This application is a continuation-in-part of applicant's co-pending application Ser. No. 790,849, filed 25 Apr. 1977 now U.S. Pat. No. 4,152,809.

BACKGROUND AND OBJECTS OF THE INVENTION

Traverse-rods have heretofore been provided with lazy-tongs mechanisms for effecting even folding and unfolding of drapes (e.g. U.S. Pat. Nos. 3,013,603, 3,045,747 and 3,750,738). But none is known to be constructed for snap-together easy size-adjustment, for use with conventional traverse rods and for substantial concealment by being small in size, by the use of large decorative trim rings and/or by being made from colorless transparent or translucent plastic links. It is the principal object of this invention to provide such a lazy-tongs drapery-control device.

DETAILED DESCRIPTION OF THE DISCLOSURE

Figure 3:
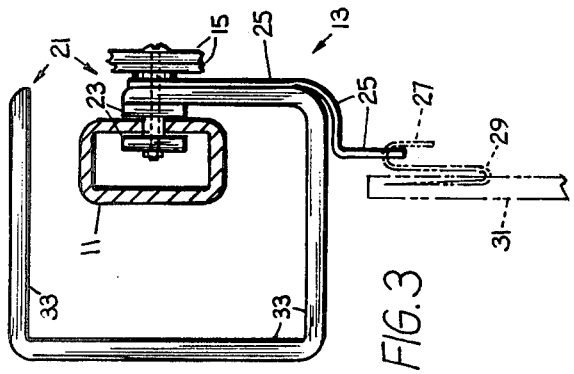
FIG. 3 is an enlarged end view of FIG. 1 in section on line 3—3 of FIG. 1.
Figure 2:
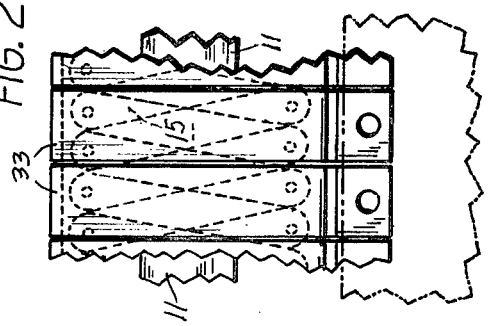
FIG. 2 is an enlarged fragmentary front elevational view of the showing of FIG. 1 with the lazy tongs fully closed.
Figure 1:
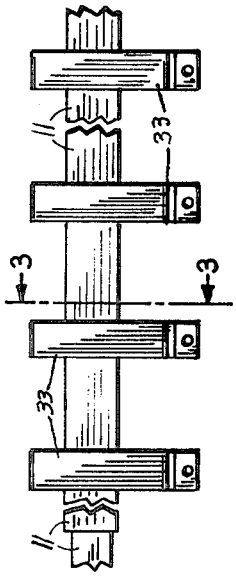
FIG. 1 is a front elevational view of a preferred embodiment of the invention.

With reference now to FIGS. 1–6 of the drawings, the numeral 11 designates a conventional-type traverse rod which is C-shaped in transverse cross-section (FIG. 3). The numeral 13 generally designates the lazy-tong assemblage of FIGS. 1–6 assembled with said traverse rod 11.

Figure 6:
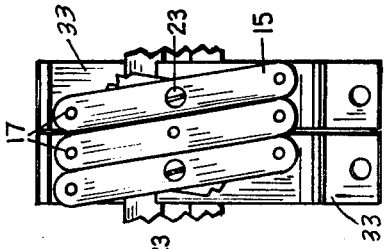
FIG. 6 is a view like FIGS. 4 and 5 but showing the lazy-tongs fully closed.
Figure 5:
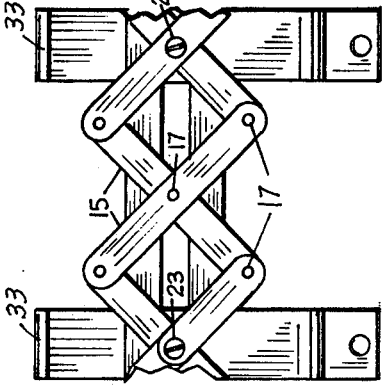
FIG. 5 is a view like FIG. 4 but with the lazy-tongs in intermediate condition.
Figure 4:
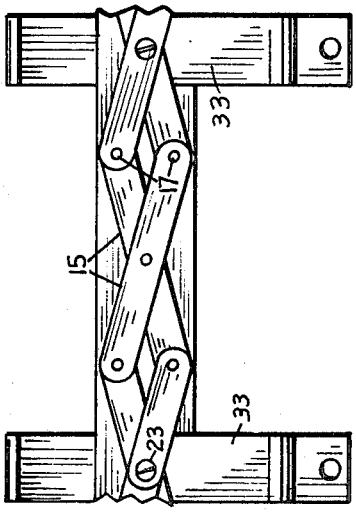
FIG. 4 is an enlarged fragmentary rear elevational view of FIG. 1 with the lazy-tongs fully extended.

The assemblage 13 comprises a plurality of lazy-tong strips 15 formed of low-visibility non-glare transparent or frosted translucent colorless plastic material and dimensioned so as to be substantially fully concealed behind the traverse rod 11 when strips 15 are in their fully extended condition of FIG. 4. Each strip 15 has two end apertures and a center aperture whereby they can be interconnected to form the lazy-tong mechanism by pivot pins most of which are of a snap-connecting type 17 (like that shown in FIG. 9 and hereinafter fully described) to provide easy assemblage and length adjustability. In FIGS. 4–6 every second center pivot pin is a machine-type screw 19 which connects the lazy-tong strips 15 to the combined drapery hangers and ornamental and tongs-concealing members 21 next described.

The members 21 comprise conventional spool-shaped plastic elements 23 (FIG. 3) the hub portion of which is guidingly slidably embraced by the edges of the slot in the rear face of the C-shaped traverse rod 11. The drapery-hanger part of the member 21 is a metal strap 25 apertured at its upper end to engage over the screw 23 and apertured at its lower end (which is offset-bent to lie directly beneath the traverse rod 11) to receive the hook part 27 of a conventional pin 29 for supporting a drape 31 or the like. A large wide plastic band 33 (herein shown as molded in G-shaped side-view) serves to substantially fully conceal the lazy-tongs in their FIG. 6 condition. It also can be colored or otherwise treated to enhance its ornamental feature. All of the elements 23, 25 and 33 are joined together and to every-other pair of tong strips 15 by the screw 23 and by its co-operating nut 35. A low-friction spacing washer 37 completes the member 21.

Figure 9:
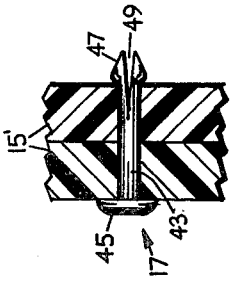
FIG. 9 is an enlarged fragmentary elevational view in section taken on the line 9—9 of FIG. 8, showing the snap-connector details.
Figure 8:
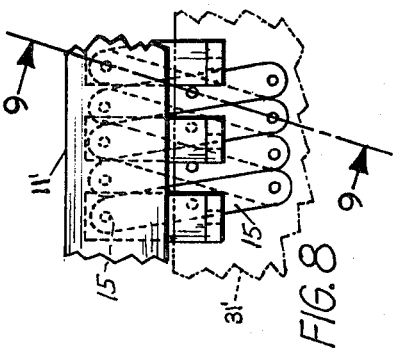
FIG. 8 is a view like FIG. 7 but showing the lazy-tongs fully closed.
Figure 7:
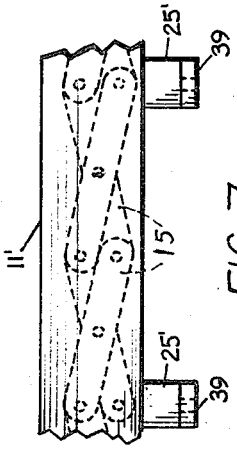
FIG. 7 is a fragmentary front elevational view of a modified embodiment of the invention showing fully extended lazy-tongs.

In the species of FIGS. 7–9, primed numerals designate parts corresponding to parts indicated by unprimed numerals in FIGS. 1–6. The drape hangers 25′ are of molded plastic and their offset portions 39 are forwardly extended so that drapery hooks (like 27–29 in FIG. 3) will locate a drape 31′ close to and directly beneath the traverse rod 11′ so as to conceal the fully closed lazy-tong elements 15′ (FIG. 8). It should be noted that the folded drapes would extend forwardly so that their top portions would furthermore act to conceal the folded lazy-tongs. The hangers 25′ are connected to every-second pair of tong elements 15′ by screws 23′ which screws also connect to elements 15′ some spool-shaped traverse-rod-engaging elements (not shown) like element 23 in FIG. 3.

In both species, an end pair of the tong elements is anchored to the traverse rod in any convenient manner and conventional pull cords can be placed in the rod (e.g. as shown in the parent application). Also conventional sliding hanger-fixtures like part 41 (FIG. 1) are attached to the free end of the tongs of both species.

FIG. 9 shows details of the snap-connecting pivot pin 17 used with both embodiments of the invention. A plastic shaft 43 has an enlarged head 45 and a tapered enlarged tip 47 which is split at 49 to permit radial contraction for and during its insertion through aligned apertures in paired tong elements 15′.

The invention having been described, what is claimed is:

1. A low-visibility lazy-tongs device for conventional traverse rods for even folding and unfolding of drapery, comprising: a plurality of link elements, horizontally disposed pivot pins interconnecting said link elements in lazy-tongs manner, spool-shaped elements adapted for guided sliding engagement with the edges of a longitudinal slot in the rear face of a conventionally constructed tubular traverse rod, said spool-shaped elements being connected to evenly spaced pairs of said link elements with at least one pair thereof between adjacent spool-like elements not connected to one thereof, drapery-supporting elements depending from said spool-like elements, said link elements being sufficiently small so that they will be substantially fully concealed behind said traverse rod when the lazy-tongs linkage formed by said link elements is fully extended.

2. A device according to claim 1 wherein a relatively wide traverse-rod-surrounding ornamental band is attached to each of said spool-like elements so as to substantially fully cover said traverse rod and the space between the drape top and said traverse rod when the lazy-tongs linkage is fully closed.

3. A device according to claim 2 wherein said ornamental bands and said drapery-supporting elements are connected to said spool-like elements by spaced ones of said pivot pins.

4. A device according to claim 2 wherein said link elements have low-visibility characteristics.

5. A device according to claim 1 wherein said low-visibility of said lazy-tongs device is provided by said drapery-supporting elements being constructed to hold the top of drapes close to and directly beneath said traverse rod so as to conceal downwardly extended link elements when said lazy-tongs linkage is closed.

6. A device according to claim 1 wherein said link elements are formed for clear transparent material.

7. A device according to claim 6 wherein the surfaces of said link elements are made non-reflective.

8. A device according to claim 1 wherein said link elements are formed of translucent material.

9. A device according to claim 8 wherein the surfaces of said link elements are made non-reflective.

10. A device according to claim 1 wherein at least a major portion of said pivot pins are of a snap-connecting type for providing quick and easy assemblage and/or length adjustment.

* * * * *